US009878553B2

(12) United States Patent
Norasak

(10) Patent No.: US 9,878,553 B2
(45) **Date of Patent: *Jan. 30, 2018**

(54) FLUID EJECTION DEVICE FOR DEPOSITING A DISCRETE QUANTITY OF FLUID ONTO A SURFACE

(71) Applicant: Funai Electric Co., Ltd., Osaka (JP)

(72) Inventor: Sam Norasak, Lexington, KY (US)

(73) Assignee: Funai Electric Co., Ltd, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/450,294

(22) Filed: Mar. 6, 2017

(65) Prior Publication Data

US 2017/0173954 A1 Jun. 22, 2017

Related U.S. Application Data

(63) Continuation of application No. 14/672,688, filed on Mar. 30, 2015, now Pat. No. 9,586,399.

(51) Int. Cl.
*B41J 2/14* (2006.01)
*B41J 2/175* (2006.01)

(52) U.S. Cl.
CPC ..... *B41J 2/17523* (2013.01); *B41J 2/17503* (2013.01); *B41J 2/17506* (2013.01); *B41J 2/17509* (2013.01)

(58) Field of Classification Search
CPC ..... B41J 2/17523; B41J 2/17503; B41J 2/17506; B41J 2/17509
USPC ..... 347/86, 65
See application file for complete search history.

(56) References Cited

U.S. PATENT DOCUMENTS 5,933,172 A * 8/1999 Park ..... B41J 2/17509 347/85
2005/0012791 A1* 1/2005 Anderson ..... B41J 2/14129 347/85
2008/0156118 A1* 7/2008 Takaya ..... G01N 35/10 73/864.14

* cited by examiner

*Primary Examiner* — Huan Tran
*Assistant Examiner* — Alexander D Shenderov
(74) *Attorney, Agent, or Firm* — Amster, Rothstein & Ebenstein, LLP

(57) ABSTRACT

A fluid ejection device includes a body defining an interior bore, a fluid reservoir, and a fluid ejection chip. The fluid reservoir defines an interior passage that receives a fluid, the interior passage in fluid communication with the interior bore of the body. The fluid ejection chip is coupled with the body and includes one or more fluid ejection actuators. The fluid ejection chip has one or more interior fluid paths in fluid communication with the interior bore of the body so that the fluid ejection chip ejects the fluid upon activation of the one or more fluid ejection actuators. The interior passage of the fluid reservoir and the one or more interior fluid paths are substantially devoid of obstructions such that the fluid is gravity fed to the fluid ejection chip upon entry into the interior passage of the fluid reservoir.

14 Claims, 3 Drawing Sheets

FLUID EJECTION DEVICE FOR DEPOSITING A DISCRETE QUANTITY OF FLUID ONTO A SURFACE

RELATED APPLICATION

This application is a Continuation of U.S. patent application Ser. No. 14/672,688, filed Mar. 30, 2015, the contents of which are incorporated herein by reference in their entirety.

FIELD

This invention is related to fluid ejection devices, and in particular, to fluid ejection devices that minimize fluid waste.

BACKGROUND

In some applications, discrete quantities of fluid are deposited onto a surface, for example, pharmaceutical applications, chemical applications, industrial applications, and medical testing applications, to name a few. Accordingly, fluids may be transported from a fluid reservoir and applied to a target surface with a fluid applicator, such as, for example, a pipette or fluid dropper.

SUMMARY OF THE INVENTION

An object of the present invention is to provide a fluid ejection device for depositing predetermined quantities of fluid onto a target surface.

Another object of the present invention is to provide a fluid ejection device for ejecting a predetermined quantity of fluid while minimizing any remainder fluid to be stored in the fluid ejection device so that fluid waste is minimized.

In exemplary embodiments of the present invention, a fluid ejection device comprises a body defining an interior bore, a fluid reservoir, and a fluid ejection chip. The fluid reservoir defines an interior passage that receives a fluid, the interior passage in fluid communication with the interior bore of the body. The fluid ejection chip is coupled with the body and comprises one or more fluid ejection actuators. The fluid ejection chip has one or more interior fluid paths in fluid communication with the interior bore of the body so that the fluid ejection chip ejects the fluid upon activation of the one or more fluid ejection actuators. The interior passage of the fluid reservoir and the one or more interior fluid paths are substantially devoid of obstructions such that the fluid is gravity fed to the fluid ejection chip upon entry into the interior passage of the fluid reservoir.

In embodiments, at least a portion of the fluid reservoir protrudes from the body.

In embodiments, the one or more fluid ejection actuators are thermal ejection actuators.

In embodiments, the fluid ejection chip comprises a substrate, a flow feature layer disposed over the substrate, and a nozzle layer disposed over the flow feature layer.

In embodiments, the fluid ejection chip comprises a nozzle layer defining one or more nozzles.

In embodiments, the fluid ejection device further comprises an electrical connector in electrical communication with the fluid ejection chip.

In embodiments, the fluid reservoir is aligned with the interior bore of the body.

In embodiments, the fluid reservoir is axially aligned with the fluid ejection chip.

In embodiments, the one or more interior fluid paths are substantially linear.

In embodiments, the body comprises a surface feature for engagement by a user.

In exemplary embodiments of the present invention, a fluid ejection system is disclosed comprising a fluid ejection printer and a fluid ejection device. The fluid ejection printer comprises a housing and at least one of an internal power source or one or more electrical contacts in electrical communication with an external power source. The fluid ejection device comprises a body defining an interior bore, a fluid reservoir, a fluid ejection chip, and an electrical connector in electrical communication with the fluid ejection printer so that power is supplied from the fluid ejection printer to the fluid ejection chip. The fluid reservoir defines an interior passage that receives a fluid, and is in fluid communication with the interior bore of the body. The fluid ejection chip is coupled with the body and comprises one or more fluid ejection actuators. The fluid ejection chip has one or more interior fluid paths in fluid communication with the interior bore of the body so that the fluid ejection chip ejects the fluid upon activation of the one or more fluid ejection actuators. The interior passage of the fluid reservoir, the interior bore of the body, and the one or more interior fluid paths are substantially devoid of obstructions such that the fluid is gravity fed to the fluid ejection chip upon entry into the interior passage of the fluid reservoir.

In embodiments, the fluid ejection printer comprises a carrier for coupling with the fluid ejection device.

In embodiments, the carrier is moveable with respect to the housing of the fluid ejection printer.

In embodiments, the fluid ejection printer comprises a controller.

In exemplary embodiments of the present invention, a method of forming a fluid ejection device is disclosed, and comprises: providing an elongate body comprising an engagement portion and an ejection portion and defining an interior bore, the ejection portion comprising a fluid reservoir extending at least partially through the body, the fluid reservoir defining an interior fluid channel; and attaching a fluid ejection chip to the body so that an interior fluid path of the fluid ejection chip is in fluid communication with the interior bore of the body, the interior fluid path, the interior bore, and the interior fluid channel together providing a fluid path that is substantially devoid of obstructions.

In embodiments, the fluid ejection chip comprises one or more fluid ejection actuators.

In embodiments, the one or more fluid ejection actuators are thermal ejection actuators.

In embodiments, the fluid ejection chip is attached to the body such that the interior fluid path of the fluid ejection chip is axially aligned with the interior fluid channel of the fluid reservoir.

In embodiments, the method further comprises the step of providing an electrical connector in electrical communication with the fluid ejection chip.

In embodiments, the engagement portion comprises a surface feature protruding from the body.

Other features and advantages of embodiments of the invention will become readily apparent from the following detailed description, the accompanying drawings and the appended claims.

BRIEF DESCRIPTION OF THE DRAWINGS

The features and advantages of exemplary embodiments of the present invention will be more fully understood with reference to the following, detailed description when taken in conjunction with the accompanying figures, wherein.

DETAILED DESCRIPTION

Figure 2:
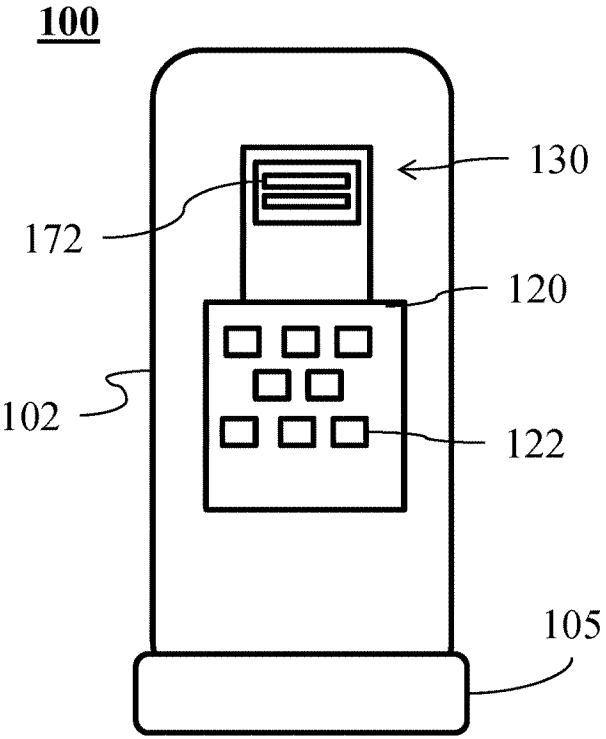
FIG. 2 is a bottom view of the fluid ejection device of FIG. 1.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

Figure 1:
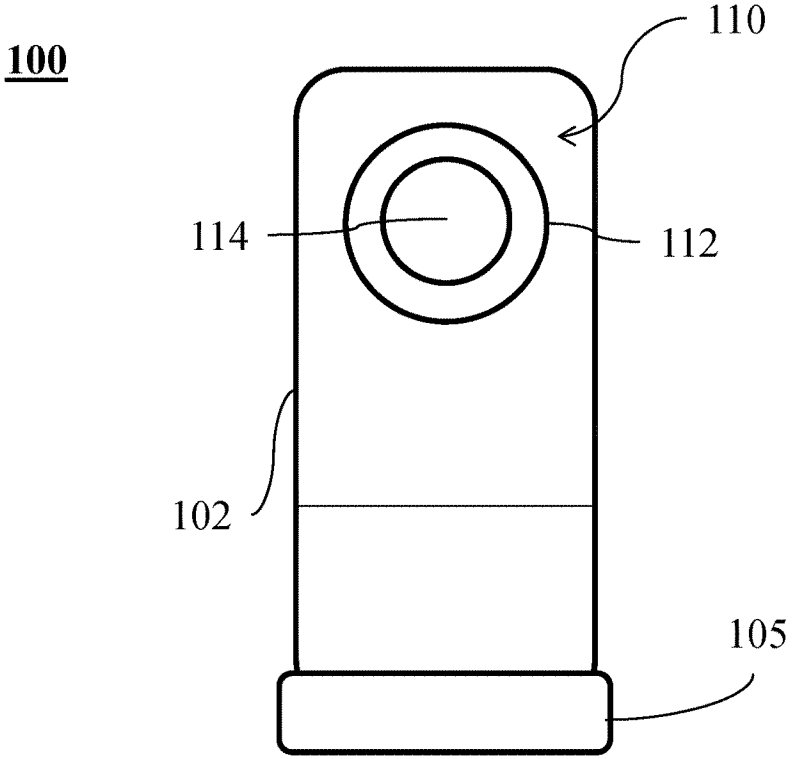
FIG. 1 is a top view of a fluid ejection device according to an exemplary embodiment of the present invention.
Figure 3:
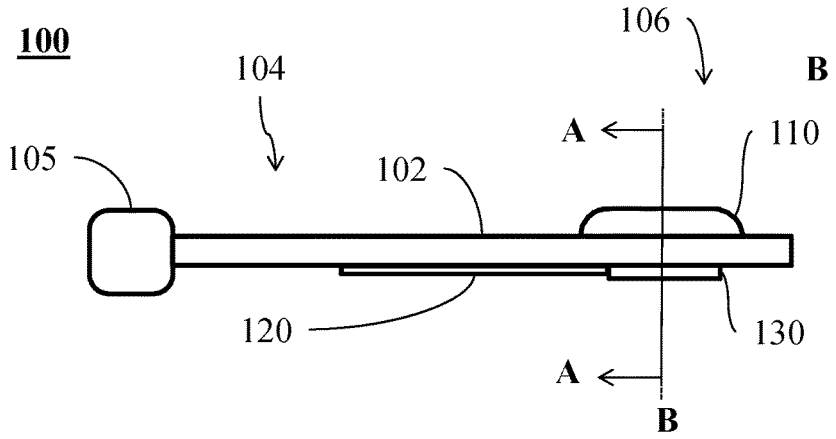
FIG. 3 is a side view of the fluid ejection device of FIG. 1.

Referring to FIG. 1, FIG. 2, and FIG. 3, a fluid ejection device according to an exemplary embodiment of the present invention is illustrated, and is generally designated 100. Fluid ejection device 100 includes a body 102 along which a fluid reservoir 110, an electrical connector 120, and a fluid ejection chip 130 are disposed.

Body 102 may be an elongate member that includes a user engagement portion 104 and an ejection portion 106. User engagement portion 104 may include a surface feature 105 (e.g., a knob, bump, or ledge) to provide a user or grasping tool with a recognizable and easily-grasped region for handling fluid ejection device 100.

Ejection portion 106 includes fluid reservoir 110, fluid ejection chip 130, and at least a portion of electrical connector 120, as described further herein. Body 102 may be formed of one or more suitable materials for applications described herein, for example, glass, polymeric materials, and composite materials, to name a few. In embodiments, user engagement portion 104 and/or ejection portion 106 may have different configurations.

As shown, electrical connector 120 extends along a portion of body 102 and is in electrical communication with fluid ejection chip 130 via one or more bond pads 122. Electrical connector 120 may be a tab automated bonded (TAB) circuit that includes electrical conductors (not shown) that can contact a portion of a fluid ejection system to provide electrical power for fluid ejection chip 130, as described further herein. In embodiments, electrical connector 120 may have a different configuration, for example, a configuration in which electrical connector 120 is interiorly disposed along at least a portion of body 102.

Fluid reservoir 110, as shown, protrudes from the surface of body 102 and presents an opening 112 into an interior fluid channel 114 (FIG. 4) extending through fluid reservoir 110. Fluid reservoir 110 may have a hollow, dome-shaped profile, as shown. Fluid reservoir 110 may be a separable component that is coupled to body 102, for example, by adhesion, welding, or mechanical coupling, to name a few. In embodiments, fluid reservoir 110 may be integrally formed with body 102. In embodiments, fluid reservoir 110 may have a different configuration, for example, a configuration in which fluid reservoir 110 is flush or recessed with the body 102 of fluid ejection device 100 and/or a configuration in which fluid reservoir 110 is not a curved structure.

Fluid ejection chip 130 is disposed along the body 102 of fluid ejection device 102 on an opposite side from fluid reservoir 110 such that one or more nozzles 172 of fluid ejection chip 130 are exposed facing a target surface upon which one or more fluids are to be deposited, for example, a testing slide or petri dish. As shown, fluid reservoir 110 and fluid ejection chip 130 are aligned along an axis B extending through fluid ejection device 100 such that a substantially linear and unobstructed fluid path is defined between the opening 112 of fluid reservoir 110 and nozzles 172 of fluid ejection chip 130, as described further herein. In this regard, fluids deposited into fluid reservoir 110 can be gravity fed to fluid ejection chip 130. In embodiments, fluid reservoir 110 may have a configuration such that a backpressure is provided to at least partially counteract the force of gravity on fluids deposited into fluid reservoir 110, e.g., to control a flow rate of fluid passing through fluid ejection device 100.

Figure 4:
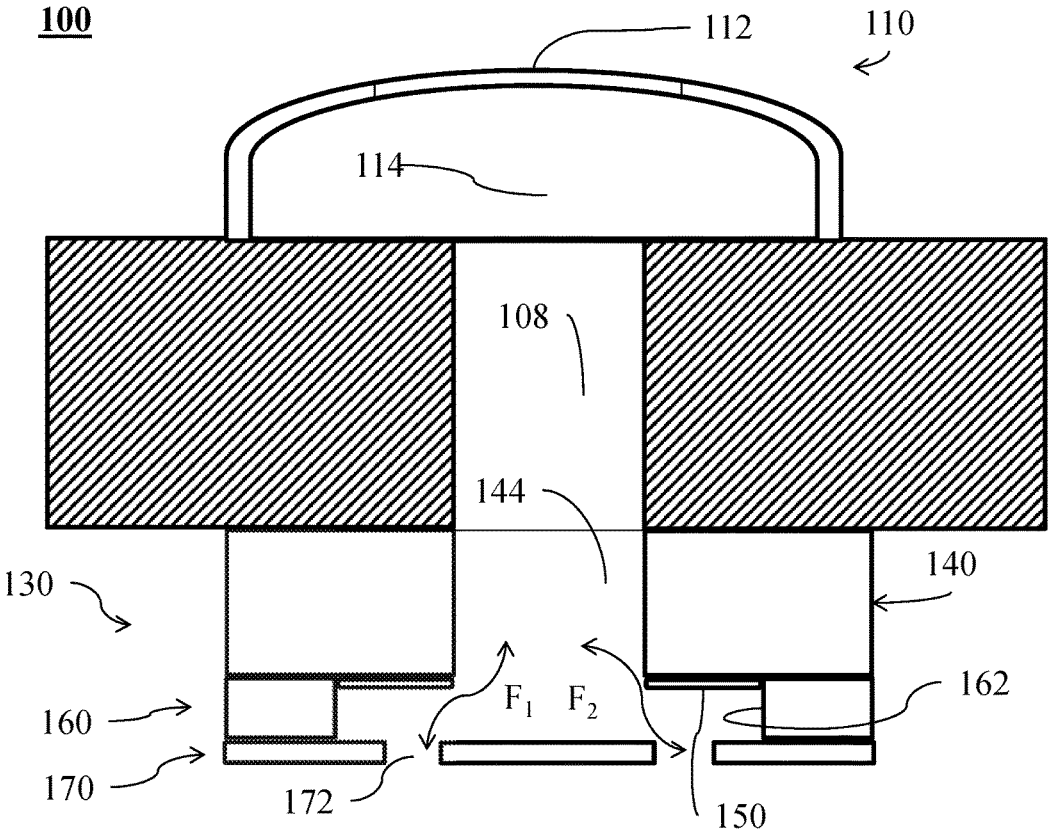
FIG. 4 is an enlarged cross-sectional view taken along the line A-A in FIG. 3.

Turning to FIG. 4, an enlarged cross-sectional view of a portion of fluid ejection device 100 is shown, including fluid reservoir 110 and fluid ejection chip 130.

As shown, the interior fluid channel 114 may widen downwardly in the direction of body 102, along a vertical distance of, for example, about 5 mm. In this regard, the interior fluid channel 114 may widen from a narrowest interior diameter at opening 112 of, for example, between about 5 mm and about 15 mm, to a widest interior diameter of, for example, between about 15 mm and about 25 mm where the fluid reservoir 110 meets the body 102. In embodiments, interior fluid channel 114 may widen from an interior diameter of, for example, 10 mm at the opening 112 to a diameter of, for example, 18 mm at the widest portion of interior fluid channel 114.

In this regard, fluid reservoir 110 is dimensioned to accommodate a volume of fluid. In embodiments, fluid reservoir 110 may be dimensioned to accommodate, for example, between about 1.8 $cm^3$ of fluid and about 4.1 $cm^3$ of fluid. In embodiments, fluid reservoir 110 may be dimensioned to accommodate about 0.5 grams of a water-based fluid.

As shown, body 102 includes an interior bore 108 upon which fluid reservoir 110 is disposed so that a fluid path is formed between the interior fluid channel 114 of the fluid reservoir 110 and the interior bore 108 of the body 102. Interior bore 108 may have a similar diameter to the interior diameter of the widest portion of fluid reservoir 110, for example, between about 15 mm and about 25 mm. In embodiments, interior bore 108 may have a different diameter.

Fluid ejection chip 130 may be mounted to body 102 in a suitable fashion, for example, adhesion, molding, or ultrasonic welding. In this regard, fluid ejection device 100 can be assembled by providing body 102 having fluid reservoir 110 and attaching fluid ejection chip 130 to a portion of body 102 such that an interior fluid path of the fluid ejection chip 130 is in fluid communication with the interior bore 108 of the body 102 and the interior fluid channel 114 of the fluid reservoir 110 to provide a substantially unobstructed fluid path.

Fluid ejection chip 130 may include a substrate 140, a plurality of fluid ejector elements 150, a flow feature layer 160, and/or a nozzle layer 170. In embodiments, ejection chip 130 may have a different configuration.

Substrate 140 may be formed of semiconductor and/or insulator materials, for example, silicon, silicon dioxide, sapphire, germanium, gallium arsenide, and/or indium phosphide, to name a few. A portion of the substrate 140 may be processed to form one or more fluid channels 144 in fluid communication with the interior bore 108 of the body 102. As described herein, processing portions of a fluid ejection chip may include, for example, mechanical deformation such as grinding, chemical etching, or patterning desired structures with photoresist, to name a few.

One or more ejector elements 150 may be disposed on the substrate 110. Ejector elements 150 may be comprised of one or more conductive and/or resistive materials so that when electrical power is supplied to the ejector elements 150, heat is caused to accumulate on and/or near the ejector elements 150 to eject fluid therefrom, as described further herein. In this regard, ejector elements 150 may be configured as thermal ejection actuators. In embodiments, ejector elements 150 may be formed of more than one layered material, such as a heater stack that may include a resistive element, dielectric, and protective layer. The amount of heat generated by ejector elements 150 may be directly proportional to the amount of power supplied to the ejector elements 150. In embodiments, power may be supplied to ejector elements 150 such that a predetermined thermal profile is generated by ejector elements 150, for example, a series of electrical power pulses of constant or variable amplitude and/or duration to achieve intended performance. In embodiments, ejector elements 150 may have a different electrical power configuration, for example, with the use of a piezoelectric element. In embodiments, an ejector element having a different configuration may be used with fluid ejection chip 130, for example, an ejector element that ejects fluid through the transfer of kinetic energy such as an electroactive polymer (EAP).

A flow feature layer 160 may be disposed over the substrate 140. Flow feature layer 160 may be disposed in a layered or otherwise generally planar abutting relationship with respect to substrate 140. Flow feature layer 160 may be formed of, for example, a polymeric material. Flow feature layer 160 may be processed such that one or more flow features 162 are formed along and/or within flow feature layer 160. In embodiments, flow features 162 may have geometry and/or dimensioning so that flow features 162 are configured to direct the flow of fluid through fluid ejection chip 130.

A nozzle layer 170 may be disposed over the flow feature layer 160. In embodiments, nozzle layer 170 may be disposed in a layered relationship with flow feature layer 160. In embodiments, nozzle layer 170 may be formed of, for example, a polymeric material. Nozzle layer 170 may be processed such that nozzles 172 are provided along an exposed surface of nozzle layer 170 as exit apertures for fluid being ejected from fluid ejection chip 130. Accordingly, nozzles 172 may have geometry and/or dimensioning configured to direct the trajectory of fluid exiting fluid ejection chip 130. Accordingly, fluid ejection chip 130 defines an interior fluid volume for accommodating fluid. The various features of fluid ejection chip 130 described herein may be processed in a way so that a desired interior volume is achieved.

Respective fluid channels 144, flow features 162, and/or nozzles 172 may collectively define one or more fluid paths within fluid ejector chip 130, such as fluid path $F_1$ and fluid path $F_2$ as shown, such that fluids can move from fluid reservoir 110, through fluid ejection chip 130, and exit through nozzles 172. As described herein, fluid paths $F_1$ and $F_2$ are substantially devoid of obstructions such that the opportunity of fluids to pool, trap, or otherwise become blocked is substantially minimized. Accordingly, the fluid channel 114 of fluid reservoir 110 and the interior bore 108 of body 102, together with fluid paths $F_1$ and $F_2$, provide a substantially linear and unobstructed path through which fluids can flow so that substantially all of a fluid deposited into fluid reservoir 110 is ejected through nozzles 172. Further, by providing a fluid reservoir 110 having a desired interior volume, fluid ejector chip 130 can be provided such that a predetermined, discrete quantity of fluid is ejected onto a target surface while minimizing fluid waste due to the substantially linear and unobstructed fluid path provided by the interior configuration of fluid ejector chip 130.

Fluid ejection device 100 as described herein is suitable for use with, for example, relatively small quantities of fluid and accordingly may have a compact configuration. In this regard, fluid ejection device 100 may minimize manufacturing time and costs such that fluid ejection device 100 can be produced as a disposable device, e.g., a one-time use device. It may be desirable to use a disposable printhead design in a number of fields of application such as medical and laboratory testing, for example, to avoid sample contamination.

Figure 5:
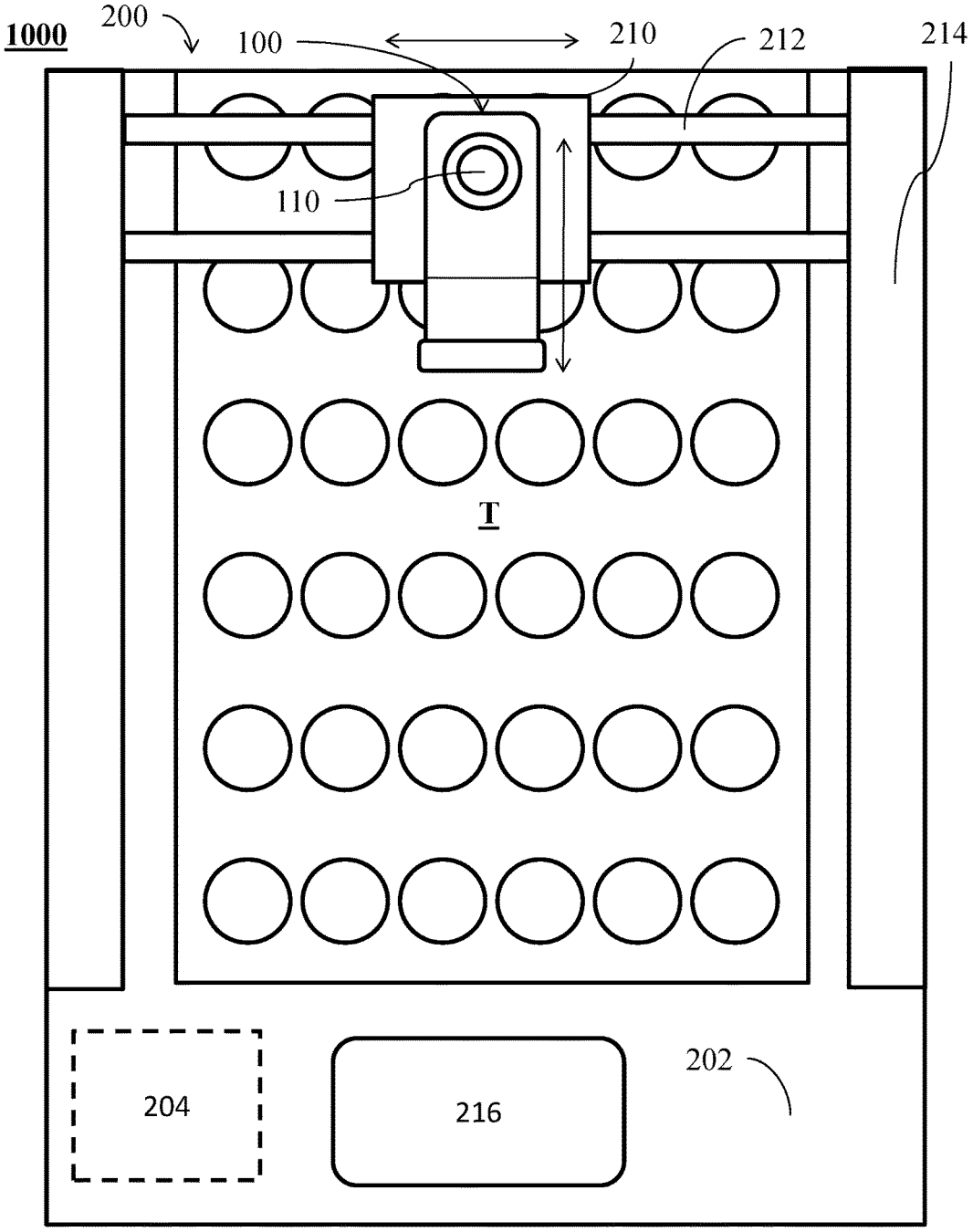
FIG. 5 is a top view of a fluid ejection system including the fluid ejection device of FIG. 1 according to an exemplary embodiment of the present invention.

Turning now to FIG. 5, a fluid ejection system according to an exemplary embodiment of the present invention is generally designated 1000. Fluid ejection system 1000 includes a fluid ejection printer 200 which is configured to receive at least a portion of fluid ejection device 100. In embodiments, fluid ejection printer 200 may receive a differently-configured fluid ejection device. Also shown is a testing surface T which may be, for example, a group of test tubes or an array of recessed reservoirs into which fluid can be deposited. In embodiments, testing surface T may be, for example, a testing slide or petri dish. In embodiments, testing surface T may be provided on a portion of fluid ejection printer 200.

Fluid ejection printer 200 includes a housing 202 and at least one carrier 210 for receiving a portion of fluid ejection device 100. In this regard, carrier 210 may include an interior recess for receiving a portion of fluid ejection device 100 and/or may present a surface suitable for coupling with fluid ejection device 100, for example, a clip, clamp, or tab structure, to name a few.

Carrier 210 may also include an electrically conductive portion (not shown) for contacting and supplying electrical power through the electrical connector 120 (FIG. 3) of fluid ejection device 100, e.g., from an internal power source or an electrical power supply line. In this regard, carrier 210 provides a physical and electrical interface between fluid ejection device 100 and fluid ejection printer 200.

In embodiments, carrier 210 may be movable with respect to fluid ejection printer 200 along a series of rails with which carrier 210 is directly and/or indirectly slidable. As shown, carrier 210 may be slidably movable along a pair of lateral rails 212, which are each in turn slidably movable along a pair of lengthwise rails 214. In this regard, carrier 210 may be movable along a two-dimensional plane parallel to the testing surface T, e.g., an x-y grid.

Fluid ejection printer 200 may also include a controller 204 for effecting various electrically-powered functions, for example, firing of ejection actuators 150 (FIG. 4) of fluid ejection device 100. Accordingly, controller 204 may include or be electronically coupled with one or more processors that can read instructions from non-transitory computer memory. Electrically powered functions of fluid ejection printer 200 may be actuated manually by a user through an interface 216, which may be, for example, buttons, knobs, toggles, and/or capacitive touchscreens, to name a few.

Referring to FIGS. 4 and 5, in use, a user may insert or otherwise mount fluid ejection device 100 to carrier 210 of fluid ejection printer 200. A quantity of fluid may then be deposited into the fluid reservoir 110 of fluid ejection device 100, for example, with a pipette or dropper. In embodiments, a quantity of fluid may be deposited into fluid reservoir 110 by an automated device, for example, a portion of fluid ejection printer 200. The quantity of fluid that can be accommodated in fluid ejection device 100 depends upon the interior volume of the fluid reservoir 110, the volume of the interior bore 108 of body 102, and the interior volume of the fluid ejection chip 130.

Upon depositing fluid into the fluid ejection device 100, one or more electrical power pulses can be provided to fluid actuators 150 to cause flash vaporization and ejection of droplets of fluid from nozzles 172.

While particular embodiments of the invention have been illustrated and described, it would be obvious to those skilled in the art that various other changes and modifications may be made without departing from the spirit and scope of the invention. It is therefore intended to cover in the appended claims all such changes and modifications that are within the scope of this invention.

What is claimed is:

1. A fluid ejection device comprising:

an engagement portion providing for a grasping engagement in mounting the fluid ejection device to a carrier;

a fluid reservoir having an opening that receives, upon the fluid ejection device being mounted to the carrier, a predetermined, discrete quantity of fluid, the fluid reservoir defining an interior passage that receives the fluid;

a fluid ejection chip comprising a fluid ejection actuatorand an interior fluid path, the fluid chip ejecting the fluid upon activation of the fluid ejection actuator; and a through hole that provides fluid communication between the interior passage and the interior fluid path, wherein the engagement portion further provides for a grasping engagement in dismounting and discarding the fluid ejection device from the carrier upon completing an operation of the fluid ejection chip ejecting the fluid from the predetermined, discrete quantity of fluid.

2. The fluid ejection device of claim 1, wherein the fluid ejection actuator is thermal ejection actuators.

3. The fluid ejection device of claim 1, wherein the fluid ejection chip comprises a substrate, a flow feature layer disposed over the substrate, and a nozzle layer disposed over the flow feature layer.

4. The fluid ejection device of claim 1, wherein the fluid ejection chip comprises a nozzle layer defining one or more nozzles.

5. The fluid ejection device of claim 1, further comprising an electrical connector in electrical communication with the fluid ejection chip.

6. The fluid ejection device of claim 1, wherein the fluid reservoir is axially aligned with the fluid ejection chip.

7. The fluid ejection device of claim 1, wherein the interior fluid path is substantially linear.

8. The fluid ejection device of claim 1, wherein the engagement portion comprises a surface feature for engagement by a user.

9. A fluid ejection printer comprising:

a housing;

at least one of an internal power source or one or more electrical contacts in electrical communication with an external power source; and a carrier for coupling with one or more fluid ejection devices, the one or more fluid ejection devices each comprising:

an engagement portion providing for a grasping engagement in mounting the fluid ejection device to the carrier;

a fluid reservoir having an opening that receives, upon the fluid ejection device being mounted to the carrier, a predetermined, discrete quantity of fluid, the fluid reservoir defining an interior passage that receives the fluid;

a fluid ejection chip comprising a fluid ejection actuatorand an interior fluid path, the fluid chip ejecting the fluid upon activation of the fluid ejection actuator;

a through hole that provides fluid communication between the interior passage and the interior fluid path; and an electrical connector in electrical communication with the fluid ejection printer so that power is supplied from the fluid ejection printer to the fluid ejection chip, wherein the engagement portion further provides for a grasping engagement in dismounting and discarding the fluid ejection device from the carrier upon completing an operation of the fluid ejection chip ejecting the fluid from the predetermined, discrete quantity of fluid.

10. The fluid ejection printer of claim 9, wherein the carrier is moveable with respect to the housing of the fluid ejection printer.

11. The fluid ejection printer of claim 9, further comprising a controller.

12. The fluid ejection printer of claim 9, wherein each fluid ejection device comprises an engagement portion that provides for a grasping engagement in dismounting and discarding the each fluid ejection device from the carrier after completing an operation of the respective fluid ejection chip ejecting the fluid from the predetermined, discrete quantity of fluid.

13. A method of ejecting a fluid from a fluid ejection device, comprising:

grasping an engagement portion on the fluid ejection device;

mounting the fluid ejection device to a carrier;

upon the fluid ejection device being mounted to the carrier, depositing a predetermined, discrete quantity of fluid into a fluid reservoir of the fluid ejection device through an opening of the fluid reservoir, the fluid reservoir defining an interior passage that receives the fluid;

activating a fluid ejection actuator of a fluid ejection chip to eject the fluid, the fluid ejection chip having an interior fluid path; and grasping the engagement portion in dismounting and discarding the fluid ejection device from the carrier upon completing an operation of the fluid ejection chip ejecting the fluid from the predetermined, discrete quantity of fluid, wherein the fluid ejection device further comprises a through hole that provides fluid communication between the interior passage and the interior fluid path.

14. The method of claims 13, further comprising the step of grasping the engagement portion in dismounting and discarding the fluid ejection device from the carrier upon completing an operation of the fluid ejection chip ejecting the fluid from the predetermined, discrete quantity of fluid.

* * * * *